United States Patent [19]

Ensing

[11] 4,424,549

[45] Jan. 3, 1984

[54] CORONA DEVICE

[75] Inventor: Hendrik Ensing, Velden, Netherlands

[73] Assignee: Oce-Nederland B.V., Venlo, Netherlands

[21] Appl. No.: 350,748

[22] Filed: Feb. 22, 1982

[30] Foreign Application Priority Data

Mar. 16, 1981 [NL] Netherlands ..... 8101260

[51] Int. Cl.[3] ..... H01T 19/04

[52] U.S. Cl. ..... 361/230; 361/213; 361/229

[58] Field of Search ..... 361/212, 213, 220, 229, 361/230; 250/324–326

[56] References Cited

U.S. PATENT DOCUMENTS

| | | | |
|---|---|---|---|
| 3,303,401 | 2/1967 | Naumann et al. | 317/262 |
| 3,483,374 | 12/1969 | Erben | 361/213 X |
| 3,649,830 | 3/1972 | Sato et al. | 250/49.5 ZC |
| 3,716,755 | 2/1973 | Marx | 317/2 F |
| 3,792,312 | 2/1974 | Marx | 317/2 F |
| 3,920,992 | 11/1975 | Van den Bogaert et al. | 250/326 X |
| 4,344,104 | 8/1982 | Habets et al. | 361/229 X |

FOREIGN PATENT DOCUMENTS 1540342 9/1976 United Kingdom .

*Primary Examiner*—Harry E. Moose, Jr.
*Attorney, Agent, or Firm*—Albert C. Johnston

[57] ABSTRACT

A corona device comprising a multiplicity of electrode pins embedded in a body of insulating material has each pin projecting from two sides of the insulating body and has this body disposed between two conductive elements, or electrodes, which are connectable to the opposite poles of a voltage source. The ends of each pin are in the electric field between the electrodes at locations between which a high potential difference is present, so that a corona discharge may develop between each end of a pin and the related electrode. The corona device may also comprise provisions for inhibiting deterioration of the pin ends subject to positive corona discharge, and/or for counteracting the positive potential so that no positive corona discharge will occur.

10 Claims, 4 Drawing Figures

CORONA DEVICE

This invention relates to a corona device especially suited for use in electrographic apparatus.

Corona devices of a type known for such use comprise a conductive element connectable to a pole of a voltage source and a body of insulating material having a number of electrode pins embedded therein, all of which pins project at one side of the insulating body into the vicinity of the conductive element where a material to be charged can be present between that element and the projecting electrode pins.

Such a corona device is usually employed in electrographic apparatus for the charging of a photoconductive element or for the creation of a field needed to aid transfer of a powder image from the photoconductive element to a receiving material. Each electrode pin generates an ion cloud which extends from the pin towards a counter-electrode, and a material to be charged, such as a photoconductive element, is located between the pins and the counter-electrode.

One problem with such a corona device is to obtain a stabilization of the current flow through each of the electrode pins so that a distribution of the corona discharge pattern is obtained that will result in a desired charge pattern on the material to be charged.

For that purpose, it is known to connect each of the pins with the voltage source by way of a separate stabilizing resistor, thus causing voltage drops across the resistors by which a more uniform distribution of the current over the separate pins is achieved. This solution, however, is disadvantageous in that it requires a large number of extra components in the form of stabilizing resistors. These not only increase considerably the material costs of the corona device, but also render its manufacture more difficult.

The principal object of the present invention is to provide a corona device which is of the type first above mentioned but by which the disadvantages noted above can be avoided.

According to the invention, a corona device is provided which comprises a conductive element and a body of insulating material having electrode pins projecting from one side of the body in a relationship as above mentioned, and which also comprises a second conductive element that is connectable to a second pole of the voltage source, and in which all the electrode pins project also from a second side of the body of insulating material into the vicinity of the second conductive element.

During the operation of this corona device, a corona discharge is brought about between each of the electrode pins and the second conductive element. Each of these further corona discharges has a stabilizing effect on the corona discharge employed to apply charge on the material to be charged.

In a first embodiment of the invention the second conductive element comprises a flat or a curved plate. In order to obtain good screening, this plate can be curved, for instance, in such a way that two edges thereof are joined completely, or almost completely, to the body of insulating material.

It will be apparent that positive charge carriers are involved in the corona discharge at one end of an electrode pin, while negative charge carriers are involved in the corona discharge at the other end of the electrode pin. Either of these corona discharges may be used in an electrographic apparatus for charging the material to be charged, depending upon the process being employed in the apparatus.

It has been found that the pin ends from which the positive corona originates may be deteriorated by the electrical discharges to a lesser or greater degree during the operation of the corona device, depending upon the material from which the electrode pins are made. In this regard, the positive-discharging ends, or points, of the electrode pins preferably are made of noble metal or covered with a layer of noble metal.

In an advantageous application of the invention, instead of a positive and a negative corona being created in the corona device, two coronas having the same polarity are generated. It has been found that this can be achieved by providing as the second conductive element a second ion-generating element extending alongside the electrode pins that project at the second side of the body of insulating material and keeping the shortest distance between the second ion-generating element and each of the electrode pins less than the distance between that element and the closest end of any of the electrode pins. In this way, the positive corona and the related deterioration of the positive-discharging electrode pin ends can be completely eliminated.

Such a second ion-generating element advantageously is constituted by a row of further electrode pins, with each of the further electrode pins being directed toward a portion of a corresponding one of the first-mentioned electrode pins projecting at the second side of the body of insulating material and being disposed at an angle to the corresponding first-mentioned electrode pin.

As a separate measure, or in addition to the measures mentioned above, deterioration of the pin points can be reduced by accommodating the pin portions which project at the second side of the insulating body in a completely closed housing filled with inert gas, with the body of insulating material mounted in a wall of this housing. Dry air as well as chemically inert gases can be considered an inert gas for this purpose.

It has been found that the streams of ions issuing from the electrode pin points toward the first conductive element form spray cones which, because of the electrical field provided between the first and the second conductive elements, are restricted in spread so that the space charge present in the spray cones limits the current flow per pin point. This restriction can be eliminated by employing between the first and second conductive elements a third conductive element located close to and electrically-conductively connected with the first conductive element, and by allowing the pins which project from the first side of the body of insulating material to project into the space between the first and the third conductive elements.

The above-mentioned and other objects, features and advantages of the invention will be further evident from the following description and the accompanying drawing of illustrative embodiments of the invention. In the drawing, the figures of which are schematic representations:

Figure 1:
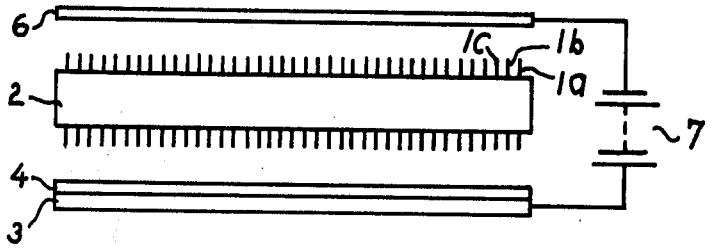
FIG. 1 shows one embodiment of a corona device in accordance with the invention.

FIG. 1 illustrates a relatively simple form of embodiment of the present invention. A row of many electrode pins, three of which are denoted by the reference symbols 1*a*, 1*b* and 1*c*, is embedded in a body 2 of electrically insulating material. As shown, although this is not essential, all the pins have the same diameter and all project by the same distance (similarly not essential) both from one side and from the opposite side of the insulating body 2. Located opposite one set, here shown as the lower set, of the projecting portions of the pins 1 there is a conductive substrate 3 on which is deposited a layer 4 of a material to be charged up, such as a photoconductive layer of an imaging medium in an electrophotographic copying machine. A second conductive element 6 is located opposite the other set of projecting portions of the pins 1, and in this case the conductive substrate 3 is to be connected to the positive pole of a voltage source 7, while the conductive element 6 is to be connected to the negative pole of the same voltage source.

During the operation of a corona device such as that illustrated in FIG. 1, negatively charged particles will be formed in a corona discharge between the lower ends of the electrode pins 1 and the conductive substrate 3, which particles propagates in the direction toward the conductive substrate 3 and thus charge up the material of layer 4 which is to be charged. On the other hand, positively charged particles will be formed in a corona discharge between the upper ends of the electrode pins 1 and the conductive element 6, and these particles propagate in the direction toward the conductive element 6.

As already pointed out above, it has been found that the points of the electrode pins from which the positive corona discharge originates, i.e., the upper ends of the electrode pins 1 in the embodiment shown in FIG. 1, are deteriorated to a greater or lesser degree in service, depending upon the material from which the electrode pins are made. When the pins are made of noble metal, or when at least their end portions exposed to attack are covered with a layer of noble metal, the deterioration will be greatly reduced or completely eliminated.

Figure 2:
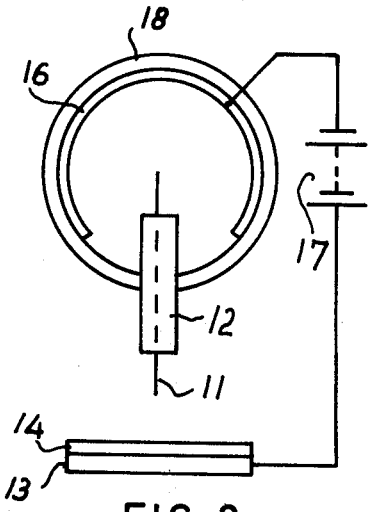
FIG. 2 shows another embodiment of such a corona device.

The deterioration of such electrode pin ends can also be reduced by generating the positive corona discharge in an inert gas atmosphere. For that purpose, as illustrated in FIG. 2, a body 12 of insulating material, having electrode pins 11 embedded in it and projecting from it at opposite sides substantially as in FIG. 1, is mounted in the wall of a housing 18 made of insulating material. In the particular case shown, the housing 18 is cylindrical and a conductive element 16 for the function of element 6 of FIG. 1 is formed as a semi-round plate which is applied against the inner surface of the insulating housing 18. A curved conductive plate similar to plate 16 can also, of itself, form the whole or part of the cylindrical housing. The lower ends of the pins 11 are again directed toward a conductive substrate 13 on which a layer 14 of the material to be charged is deposited. The substrate 13 is connected to the positive pole of a voltage source 17, and the conductive element 16 is connected to the negative pole of this voltage source. After complete closure of the housing 18, inert gas is brought into the space inside the housing. This inert atmosphere inhibits the attack of ion streams on the portions of the electrode pins 11 projecting into the housing, thus ensuring that deterioration of the pin ends will be considerably reduced if not completely eliminated.

Figure 3:
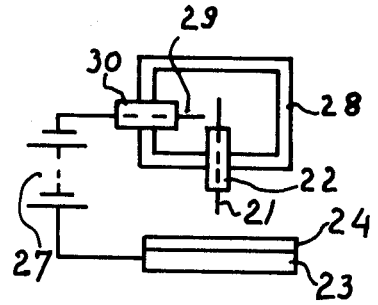
FIG. 3 shows a further and preferred embodiment thereof.

According to an embodiment of the invention as illustrated in FIG. 3, no positive corona discharge at all is generated by the corona device. In this embodiment, a first body 22 of insulating material having the electrode pins 21 embedded in it and projecting from opposite sides of it is mounted in a frame 28, and a further row of electrode pins 29 is embedded in and projects from a second body 30 of insulating material which also is mounted in frame 28. The electrode pins 29 are arranged at a mutual spacing which corresponds to the mutual spacing of the electrode pins 21, and in the arrangement shown are held perpendicular to the pins 21 with each of the pins 29 directed toward a projecting portion of a related pin 21. For example, each pin 29 projects approximately toward the center of the portion of a related pin 21 projecting from the upper side of body 22. The pins 29 are not necessarily held perpendicular to the pins 21, as other values of the angle between the pins can be employed. The portions of the electrode pins 21 projecting at the lower side of body 22 are in turn directed toward a conductive substrate 23 having thereon a photoconductive layer 24 to be charged by the corona device. The positive pole of a voltage source 27 is to be connected to the conductive substrate 23, and the negative pole to the electrode pins 29. These electrode pins project from one side only of the body 30.

During the operation of a corona device of the type illustrated in FIG. 3, a negative corona discharge is generated between the ends of the downwardly projecting portions of the electrode pins 21 and the conductive substrate 23, as a result of which the photoconductive layer 24 is charged up. Furthermore, a second negative corona discharge will occur between the projecting ends of the electrode pins 29 and the upwardly projecting portions of the electrode pins 21. This second negative discharge originates from the electrode pins 29 and progresses towards their respective related electrode pins 21, thus counteracting the positive charge condition developed in the upper portions of the pins 21 so that the problem of deterioration of their ends by a positive corona discharge is completely eliminated.

It will be obvious that the frame 28 can be formed as a closed chamber, for example as a cylinder, which can be sealed and filled with inert gas to provide further protection against attack on the upwardly projecting pin ends. It will also be obvious that a negative corona discharge directed toward the upper portions of the electrode pins 21 can be produced from a so-called "knife" electrode or from a wire electrode. In such case, the edge of the knife electrode or the wire electrode is located in alignment with a line connecting the ends of the electrode pins 29, or at another location within the frame 28, in such a way that the field strength at the ends of the upper projecting portions of the electrode pins 21 remains low enough to prevent generation of a positive corona discharge.

In the operation of the corona devices of FIG. 1 and FIG. 2, an electrical field normally is present between the respective conductive elements 3 and 6 and 13 and 16. This field restricts the spatial extension, or spread, of the spray cones formed by the discharges from the electrode pin points directed toward the conductive elements 3 and 13 respectively.

Figure 4:
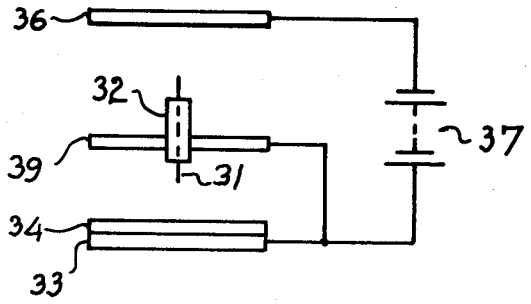
FIG. 4 shows a further preferred embodiment of a corona device in accordance with the invention.

FIG. 4 illustrates a further modification of the invention, in which a third conductive element 39 joining to a body 32 of insulating material is provided between first and second conductive elements 33 and 36. The element 33 and 36 correspond respectively to the element 3 and 6 of FIG. 1, or 13 and 16 of FIG. 2. The insulating body 32 corresponds to the body 2 of FIG. 1, or to body 12 of FIG. 2, and has embedded in it a row of electrode pins 31 corresponding to the pins 1 or pins 11.

The third conductive element 39 is electrically-conductively connected to the element 33 and to the same pole of a voltage source 37 as element 33, so that an electrical field which would restrict the spatial extension of the spray cones is no longer present between the points of the pins 31 and the conductive element 33. By this arrangement the uniformity of the charge distribution on the material 34 to be charged is improved.

What is claimed is:

1. A corona device suitable for use in an electrographic apparatus, comprising a first conductive element, a body of insulating material having a multiplicity of electrode pins embedded therein, all of said electrode pins having respective end portions thereof projecting from said body at a first side of said body and also at an opposite, second side thereof, the projecting portions of said pins at said first side extending into the vicinity of yet being spaced from said first conductive element so as to provide a space in which a material to be charged can be present between said pins and the first conductive element a second conductive element having in its vicinity yet being spaced from the portions of said electrode pins projecting from said second side of said body of insulating material so that electric discharges can flow between said second conductive element and said projecting portions at said second side and means including a D.C. voltage source having opposite poles thereof connectable respectively with said first and said second conductive elements for subjecting said pins to a difference of potential such that each of said projecting end portions of said pins at said first side will generate a spray of corona discharges directed onto a material present in said space.

2. A corona device according to claim 1, said second conductive element comprising a flat electrically conductive plate.

3. A corona device according to claim 1, said second conductive element comprising a curved electrically conductive plate.

4. A corona device according to claim 1, said second conductive element comprising ion-generating means disposed alongside the projecting portions of said electrode pins at said second side of said body, said ion-generating means being located closer to a mid-portion than to the end of each of those projecting portions.

5. A corona device according to claim 4, said ion-generating means comprising a row of further electrode pins each of which is directed toward and disposed at an angle to one of said projecting portions at said second side of said body.

6. A corona device according to claim 1, 2, 3, 4, or 5, one set of said projecting portions of said electrode pins, from the ends of which a positive corona discharge may be generated, having said ends made of noble metal or covered with a layer of noble metal.

7. A corona device according to claim 1, 2, 3, 4, or 5, said projecting pin portions at said second side of said body being disposed in a closed housing in a wall of which said body of insulating material is mounted, said housing being filled with inert gas.

8. A corona device according to claim 1, 2, 3, 4, or 5, further comprising a third conductive element which is located between said first and said second conductive elements and relatively close to said first conductive element and is electrically-conductively connected to the latter, said portions of said electrode pins at said first side of said body of insulating material projecting into the space between said first and said third conductive elements.

9. A corona device according to claim 1, said projecting portions of said electrode pins at said second side of said body having their ends made of noble metal or covered with a layer of noble metal, and being disposed in a closed housing in a wall of which said body of insulating material is mounted, said housing being filled with inert gas.

10. A corona device according to claim 9, further comprising a third conductive element which is located between said first and said second conductive elements and relatively close to said first conductive element and is electrically-conductively connected to the latter, said portions of said electrode pins at said first side of said body of insulating material projecting into the space between said first and said third conductive elements.

* * * * *